United States Patent [19]

Gladden, Jr. et al.

[11] Patent Number: 4,561,232

[45] Date of Patent: Dec. 31, 1985

[54] MODULAR TILE WITH POSITIONING MEANS FOR USE WITH AN ACCESS FLOOR PANEL SYSTEM

[75] Inventors: Robert S. Gladden, Jr., Severna Park; Richard J. Johnson, Baltimore; John C. Kidd, Baltimore; Robert A. Younkin, Baltimore, all of Md.

[73] Assignee: Tate Architectural Products, Inc., Jessup, Md.

[21] Appl. No.: 622,408

[22] Filed: Jun. 22, 1984

Related U.S. Application Data

[63] Continuation of Ser. No. 411,985, Aug. 26, 1982.

[51] Int. Cl.[4] ..... E04F 13/08

[52] U.S. Cl. ..... 52/385; 52/126.6; 52/386

[58] Field of Search ..... 52/126.6, 263, 386, 52/384, 391, 570, 598, 385

[56] References Cited

U.S. PATENT DOCUMENTS

| | | | |
|---|---|---|---|
| 362,846 | 5/1889 | Loy | 52/570 X |
| 1,704,537 | 3/1929 | Haines . | |
| 1,965,282 | 7/1934 | Ellithorpe et al. . | |
| 2,135,118 | 11/1938 | Stewart . | |
| 2,872,804 | 2/1959 | Baldanza | 52/384 |
| 3,196,315 | 8/1962 | Peterson . | |
| 3,199,257 | 8/1965 | Spiselman et al. . | |
| 3,341,996 | 9/1967 | Jones et al. . | |
| 3,425,179 | 2/1969 | Haroldson | 52/126.6 X |
| 3,548,559 | 12/1970 | Levine . | |
| 3,585,101 | 7/1968 | Stratton et al. . | |
| 3,586,598 | 6/1971 | Beemer . | |
| 3,676,971 | 7/1972 | Dombroski | 52/386 |
| 3,681,882 | 8/1972 | Bettinger . | |
| 3,808,760 | 5/1974 | Ward . | |
| 3,811,237 | 5/1974 | Bettinger . | |
| 3,862,874 | 1/1975 | Hopper et al. . | |
| 3,895,981 | 7/1975 | Tesch . | |
| 4,085,557 | 4/1978 | Tharp . | |
| 4,113,219 | 9/1978 | Mieyal | 52/126.6 X |
| 4,126,415 | 11/1978 | Coiner et al. . | |
| 4,142,341 | 3/1979 | Mott | 52/263 |
| 4,143,496 | 3/1979 | Destito . | |
| 4,153,749 | 5/1979 | Klein . | |
| 4,186,230 | 1/1980 | Sinclair et al. . | |
| 4,191,799 | 3/1980 | Gruber . | |
| 4,199,634 | 4/1980 | Pole et al. . | |
| 4,270,325 | 6/1981 | Mandelli | 52/391 |
| 4,308,304 | 12/1981 | Cochran, II . | |
| 4,450,664 | 5/1984 | McNamee | 52/385 |

FOREIGN PATENT DOCUMENTS

| | | | |
|---|---|---|---|
| 2368587 | 5/1978 | France | 52/385 |
| 1266963 | 3/1972 | United Kingdom | 52/126.6 |

*Primary Examiner*—Henry E. Raduazo

*Attorney, Agent, or Firm*—Oblon, Fisher, Spivak, McClelland & Maier

[57] ABSTRACT

A modular tile for an access floor panel system wherein the tile includes a mechanism for positively locating the tile on an access floor panel so as to be replaceable and removable without the use of indexing tools or fixtures through the tile's bottom surface or the panel's top surface and having a configuration which orients the tile to the access floor panel, the size of the tile being consistent and modular with each and every access floor panel in the access floor panel system.

18 Claims, 15 Drawing Figures

MODULAR TILE WITH POSITIONING MEANS FOR USE WITH AN ACCESS FLOOR PANEL SYSTEM

This application is a continuation, of application Ser. No. 411,985, filed Aug. 26, 1982.

BACKGROUND OF THE INVENTION

1. Field of the Invention

The present invention essentially comprises new technology in the development of a modular tile with means to position, index and maintain position to an access floor panel system, while remaining removable and replaceable without the use of adhesive indexing tools, or fixtures.

2. Description of the Prior Art

With the advent of access flooring, comprised of a modular embodiment of a rigid structural floor panel supported on pedestal columns, being used as an accessible floor providing an underfloor space or cavity for use in distributing HVAC, electrical power, CRT, and other communication connections, in the office space, problems arose with the finish on the floor which was typically carpet. The initial access flooring for such purposes had the carpet finish bonded to each modular panel at the factory, where the finish could be exactly indexed by fixturing and manufacturing methods which maintained the carpet module to the exact dimensions of the panel module. This bonding and registration provided the ability to move individual panels and their covering as one unit from space to space in the building, which allowed for movement of electrical, telephone and HVAC penetrations to other locations as offices were moved within the building.

When this factory-applied carpet required replacement, the carpet could, with difficulty, be stripped from the access floor panel, but required similar indexing and manufacturing means as provided in the factory, to index and apply in a modular fashion new carpet to the access floor panel.

Typical prior art of this type of construction is shown in U.S. Pat. Nos. 3,681,882 to Bettinger, issued 8/8/72; 3,811,237 to Bettinger, issued 5/21/74; 4,085,557 to Tharp, issued 4/25/78; and 3,548,559 to Levine, issued 12/22/70.

Although application of carpet to the access floor panel in this manner provided a consistent module, other problems were created. Typically, in a building cycle, the access floor is installed prior to other services being installed in the building such as a sprinkler system, drywall, and electrical and telephone distribution. Since these services were being installed over a finished carpeted floor, efforts were required to protect this floor while these other trades were working. Protection was expensive and often inadequate, causing costly cleaning and, in some cases, replacement of both carpet and panel, due to damage to the bonded finish.

In recent years, this problem has been overcome by use of carpet tiles which typically are modular carpet squares with a more rigid vinyl backing, to hold a tile flat when laid. Such carpet tile, although modular, has no means to maintain a consistent module with the access floor panel, and typically is of a different module size. Normally, such carpet tile also requires use of a releasable adhesive, in total or in part, to prevent shifting of the tile on the access floor panel surface.

Use of tiles of this type, because they are not modular to the access floor panel, requires significant additional carpet stock to be maintained, so that when offices are relocated with their supporting service penetrations through the access floor, the tiles that do not line up in the new area, must be discarded, and replaced with new tiles. Typical additional tile stock, based on a rate of 2.5 affected tiles per move, an office-move rate of 25% per year, and a 10-year life cycle, requires 25% additional tiles to be purchased initially, which will insure uniformity of carpet color over the life of the building.

Prior art in the access floor industry has failed to maintain the tile module with the access floor module, to reduce this excessive initial cost, in any other manner other than factory-glued carpet with its own set of problems. Attempts have been made to field index and laminate carpet access floor panels, but the extra handling costs and reduced efficiency is not cost effective.

The mere use of a projection on a tile or fixture for location purposes is not new, as shown by the following prior U.S. patents:

| U.S. Pat. No. | Name | Date of Patent |
|---|---|---|
| 2,135,118 | Stewart | 11/01/38 |
| 1,704,537 | Haines | 03/05/29 |
| 4,143,496 | Destito | 03/13/79 |

In reviewing said prior art patents, although each demonstrates positioning of a tile or fixture by use of projections, dimples, or spring clips, each is functioning on a continuous surface, and maintains no modularity to a modular substructure. Should a large section of the substructure require removal, multiple tile or fixture units which would require removal for access.

In U.S. Pat. No. 1,704,537 to Haines, the position and modular tile when indexed on the substrate is then cemented to the substrate, and the protrusions are used for initial positioning only, but fixity is maintained by the tile cemented to the substrate.

U.S. Pat. No. 2,135,118 to Stewart, demonstrates embodiments of rough locating projections and spring clip arrangements that are then cemented or adhered in place for maintenance of final positioning. Here, as in other prior art, the tiles or fixtures are modular to one another, but are not modular to a modular substrate.

In U.S. Pat. No. 4,143,496 to Destito, a flat rectangular holding frame member is provided on one side with adhesive tape adjacent the edge thereof, which is covered by a peel-off film which, upon removal, allows the frame to be applied to the surface of a wall for adherence thereto, and on the other side, is provided with a snap fastener for removably holding a flat, domino decoration-bearing rectangular face member which is similar in size and shape to that of the frame member, having a mating snap fastener on the back thereof, in place thereon, so that a wall decorated with a plurality of different domino spots, or blanks, can be arranged on the frame member at will without removing the frame members from the wall surface. It can therefore be appreciated that in Destito, a series of frames are attached to the wall, which itself is not modular, by adhesion and, while the frames are modular to one another, such are not modular to the wall surface. Furthermore, Destito relates merely to a wall decorating device rather than to a modular tile for an access floor panel system as utilized in the present invention.

In other parallel prior art to the present invention, such as shown in U.S. Pat. No. 3,862,874 to Hopper, et al, issued 1/20/75, the modular rug unit is shown which is mechanically fastened to one of a number of embodiments of tape substructures which allow for individual and/or entire unit removal from the substrate. This requires layout of the tape arrangement in an overall, not modular pattern, and would not provide individual access through the substrate, in a consistent modular fashion.

One other parallel U.S. patent which demonstrates similar technology to one embodiment of the present patent is U.S. Pat. No. 3,341,996 to Jones, et al, issued 9/19/67 which shows a magnetic backing material or substrate material for use in holding modular tiles to a substrate. This prior art does not demonstrate any modular fixing to the substructure, although the tiles may be made modular to one another. Use of this prior art would allow for application of tile modules to a panel in a similar fashion to factory-applied carpet, but would require similarly indexing and other manufacturing means to maintain modular alignment to the access floor panel system.

By such exploration, it has been determined that the prior art, although demonstrating some similar embodiments to embodiments included in the present invention, does not demonstrate the key features provided in the current invention.

SUMMARY OF THE INVENTION

The prime object of this present invention is to provide a tile with a means to be positively located on an access floor panel, being field replaceable and removable without the use of glue, indexing tools or fixtures, through the tile's bottom surface or the panel's top surface having a configuration which orients the tile to the access floor panel, the size of said carpet tile being consistent and modular with each and every access floor panel in the system.

It has been found that a tile can be manufactured, with positively located projections or recesses, which can be indexed into die formed holes or projections in the access floor panel, respectively, providing a positive index and modular to modular control for each tile to each and every access floor panel. The advantages of this invention are that each access floor panel provided, forms a permanent, yet portable fixture for each tile provided. The positioning of the tile, not only indexes the tile to the access floor module, but prevents shifting of the tile on the module, and simplifies the future replacement of the floor covering. As offices are relocated in the building, and the service penetrations are similarly moved, the access floor panel, and its service fittng, together with its tile, can be relocated to the new location, without loss of tiles due to misalignment of penetrations.

BRIEF DESCRIPTION OF THE DRAWINGS

Various objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

To provide an understanding of certain terms used in the specification and claims of this application, the following definitions are set forth:

DEFINITIONS

System Module—the nominal size (length and width) of each access floor panel unit; also the nominal spacing of access floor panel supporting members laterally and longitudinally; also the nominal size (length and width) of each modular tile.

Modular Tile—a floor covering unit nominally equivalent in size to the system module.

On-Module—the location of each modular tile directly on top of each individual access floor panel with no overlap.

Off-Module—the location of a modular tile, offset from the system module by ½ module, such that each modular tile will cover the four adjacent quarters of four adjacent panels.

Indexing Tool or Fixture—a separate tool made to position the floor covering to a pre-determined location relative to the floor panel module, so that the two units can be assembled on module.

Tile—a secton of any of a number of floor covering materials such as: (but not limited to) Carpet resilient tile, i.e. rubber, vinyl, cork, linoleum wood parguetry, wood strip, plywood, HPL ceramic tile, marble, terra cotta, terrazzo artificial glass.

Substantially of the same size—dimensionally nearly identical to a referred object within manufacturing tolerances acceptable within the industry and, in the present case, such tolerance is within 0.5% of each dimension (length and width) of each modular tile.

Hole—an opening, recess, groove or similar aperture or indentation allowing for reception of a cooperative projection therewithin.

Projection—an element raised from the upper or lower surface of a tile or panel for cooperation with a corresponding hole.

Position modularity—a dimensional relationship between a tile and a corresponding panel or group of panels which allows for interchangeability of said tile with any other panel so as to provide a predetermined acceptable fit with one another.

Figure 1:
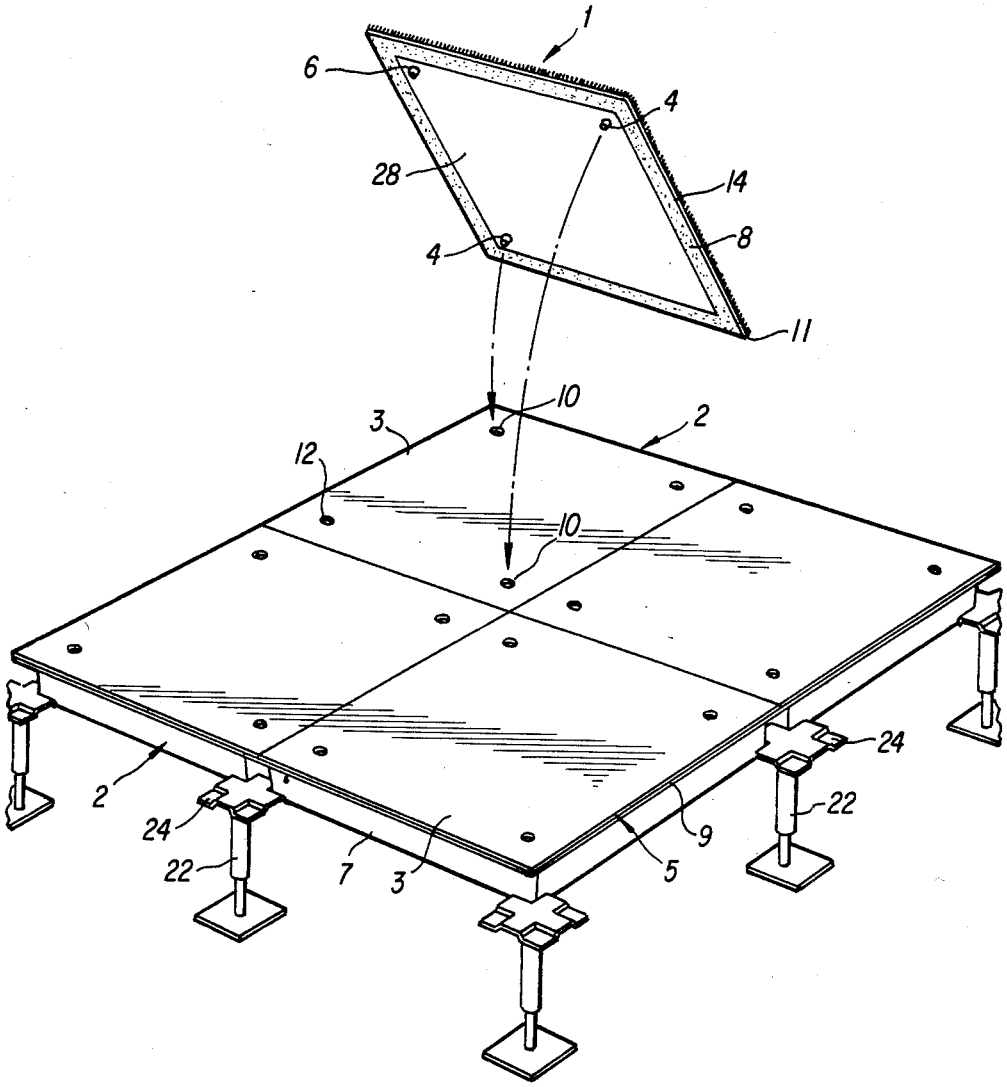
FIG. 1 is a perspective view, partially exploded, showing an access floor panel system with a tile shown exploded in relationship with the access floor panels.

Referring initially to FIG. 1, shown therein is a perspective view, partially exploded, illustrating a modular tile 1 which is operatively associated with an access floor panel 2 made of, for example, steel or plastic. As shown in FIG. 1, the series of access floor panels 2 form an access floor panel system upon which is mounted one or more tiles 1.

Reference number 3 indicates a top surface portion of each access floor panel 2 while reference number 4 indicates at least one projection extending downwardly from a bottom surface portion 28 of the tile 1. Reference number 5 denotes an edge flange of each access floor panel 2.

Each tile can be provided with an optional projection 6 for directional control and orientation of the tile 1 with respect to each access floor panel 2. Reference number 7 indicates the side wall of each access floor panel 2 while reference number 8 indicates a magnetic or pressure sensitive adhesive perimeter of each tile 1 which also is optional and which serves to prevent lifting or curling of the tile 1 along the edge portion or perimeter 9 thereof or at a corner 11 thereof such that each tile 1 is removable and replaceable without the use of indexing tools or fixtures.

Reference number 10 indicates a positioning hole for on module installation. Upon engagement of tile 1 with one or more respective access floor panels 2, the projections 4 in each tile 1 serve to position, index and maintain position modularity of the tile 1 relative to the access floor panel system. The projections 4 cooperating with the positioning holes 10 are of corresponding configuration so as to orient each tile 1 to each of the panels 2 such that each tile is removable and replaceable without the use of indexing tools or fixtures and such that each tile is substantially of panel module size.

It is important to note that, in accordance with the invention, the modularity of the panels 2 and also the tiles 1 are dimensionally consistent such that each tile can be relocated on any other panel so as to maintain a consistent modular interface.

As can be appreciated from a review of FIG. 1, it is possible for a single projection 4 from each tile 1 to serve as a positioning and indexing means which indexes into only one positioning hole 10 formed in each of the floor panels 2 due to engagement of adjacent edge portions or perimeters 14 of each tile upon being mounted on two or more adjacent access floor panels 2.

An adjustable pedestal 22 in combination with a support platform 24 serves to support each of the access floor panels 2 from a floor in a conventional manner. The manner of use of the adjustable pedestal 22 and support platform 24 are apparent from a review of FIGS. 1–3.

Figure 2:
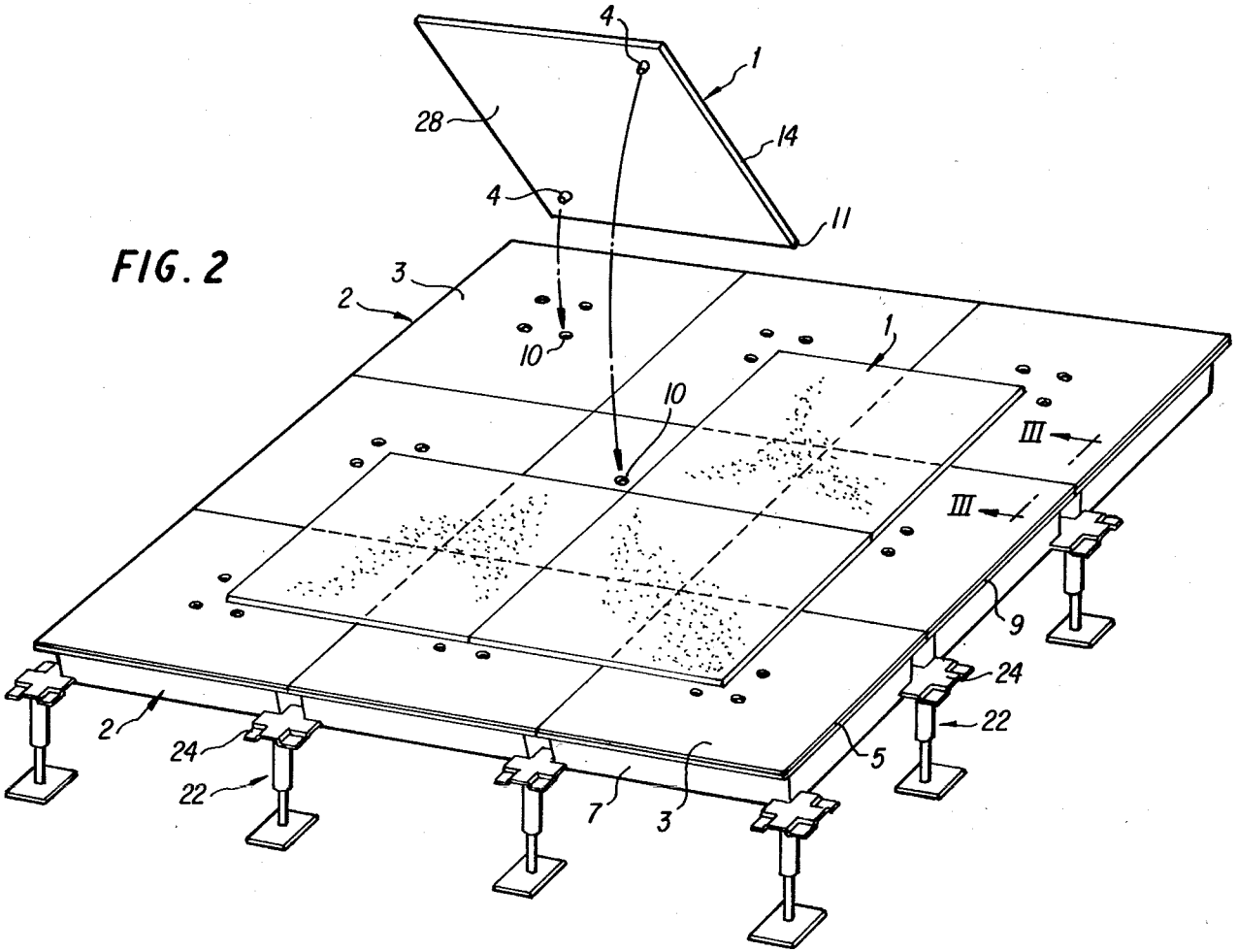
FIG. 2 is a view similar to FIG. 1, showing an alternate arrangement of tiles on the access floor panels.
Figure 3:
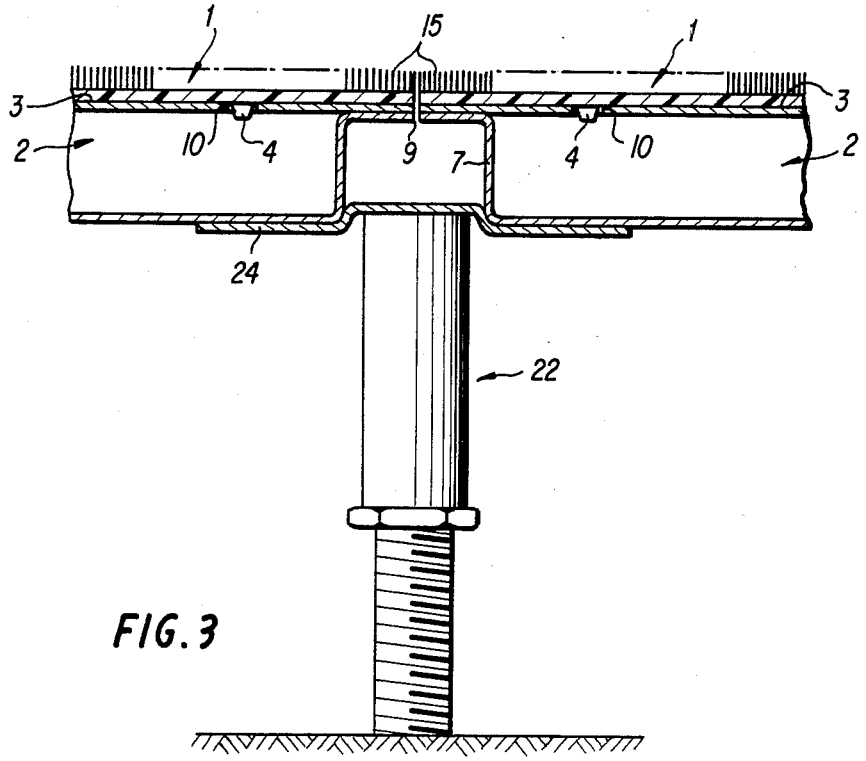
FIG. 3 is a vertical cross-sectional view taken on lines III—III of FIG. 2.

FIG. 2 serves to illustrate a view similar to that of FIG. 1 but showing an alternative arrangement of tiles 1 on the access floor panels 2. More particularly, while the arrangement of projections 4 on the bottom surface portion 28 of each tile 1 is the same as that as shown in FIG. 1, the arrangement of the positioning holes 10 differs from that of FIG. 1 insofar as the positioning holes are located in a central portion of each access floor panel 2 so as to allow for overlapping of a single tile 1 onto adjacent quarter sections of four panels. Otherwise, the embodiment shown in FIG. 2 directly corresponds to the structural element shown in FIG. 1.

FIG. 3 again relates to a vertical cross-sectional view taken on lines III—III of FIG. 2 and serves to more clearly illustrate the manner in which the panels 2 are supported by pedestal 22 and support platform 24 as well as the cooperative engagement of edge portion or perimeter 9 of each panel and the cooperative engagement of edge portion or perimeter 14 of each tile 1.

Figure 4:
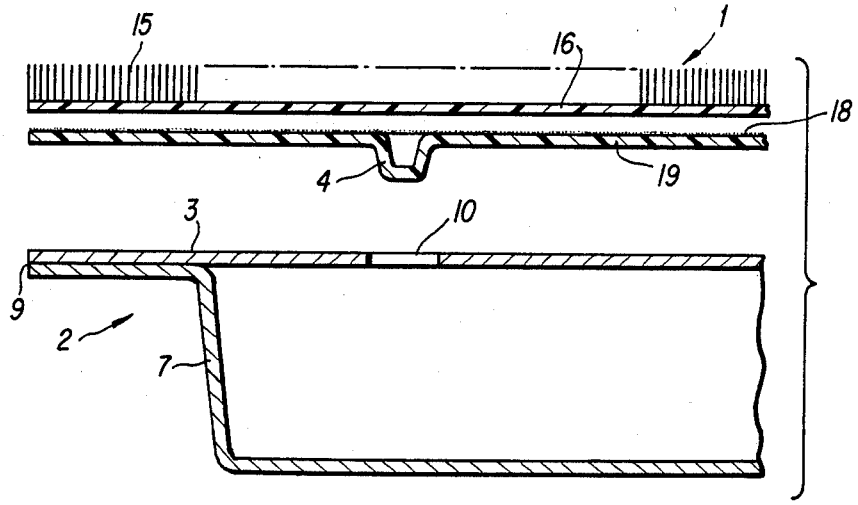
FIG. 4 is an exploded vertical cross-sectional view showing in greater detail the structure of FIG. 1.

Next referring to FIG. 4, such illustrates an exploded vertical cross-sectional view showing in greater detail the structure of tile 1 and access floor panel 2. More particularly, reference number 15 denotes a carpet pile or similar surface such as, for example, a vinyl surface, an asbestos surface, a rubber surface or a similar type of surface found to be acceptable in the floor covering industry. Reference number 16 serves to indicate a primary backing of carpet pile 15 while reference number 18 denotes an adhesive bond for the carpet primary backing 16. A backing structure 19 is utilized to serve as a further backing for the primary backing 16 wherein the projections 4 are integral with and extend from the plane of backing structure 19 for indexing into positioning hole 10 formed in access floor panel 2. Backing structure 19 therefore serves to engage top surface portion 3 of access floor panel 2.

Figure 5:
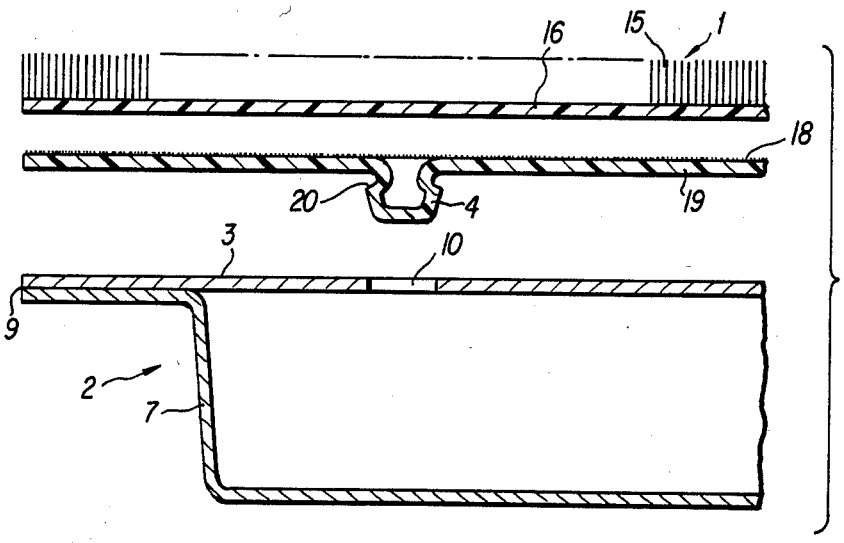
FIG. 5 is a view similar to FIG. 4 showing an alternative configuration of the projection on the tile.

FIG. 5 shows an alternate embodiment of the structure of FIG. 4 wherein the projection 4 extending from backing structure 19 is formed with undercut snaps 20 for a more secure engagement with positioning hole 10 to prevent uplift.

Figure 6:
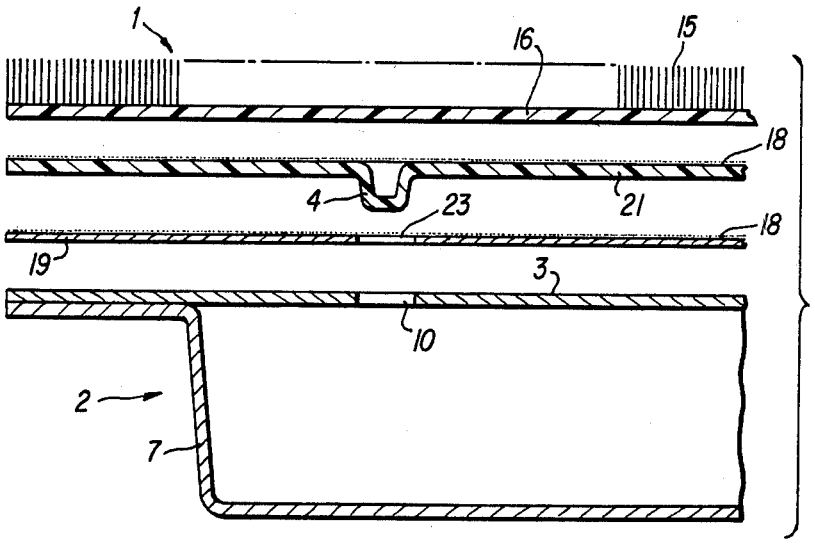
FIG. 6 is a view similar to FIG. 4 showing yet another type of projection on the tile.

FIG. 6 shows yet another alternate embodiment of the structure of FIG. 4 which utilizes a conductor 21 in the form of a backing. As seen in FIG. 6, projection 4 extends through a hole 23 formed in backing structure 19 and also cooperates with projection hole 10 formed in floor panel 2. Accordingly, projection 4 extending from conductor 21 also serves to position, index and maintain the position of the tile 1 relative to the access floor panel 2 wherein projection 4 and conductor 21 are made of a conductive material for providing improved resistance to static electricity build-up on the surface of the tile while also being of a configuration which orients the tile 1 to each of the panels 2 such that the tile 1 is removable and replaceable without the use of the aforementioned indexing tools or fixtures.

Figure 7A:
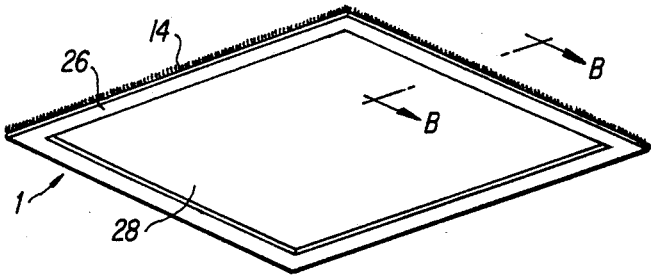
FIG. 7A is an underside perspective view of the tile of an alternate embodiment.
Figure 7B:
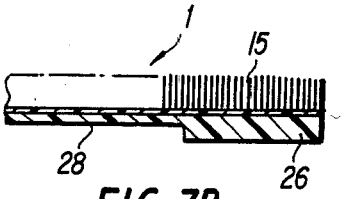
FIG. 7B is a vertical cross-sectional and fragmentary view on line B—B of FIG. 7A.

FIGS. 7A–7E serve to illustrate yet another embodiment of the present invention wherein FIG. 7A illustrates an underside perspective view of the tile 1 while FIG. 7B shows a vertical cross-sectional fragmentary view taken along line B—B of FIG. 7A. These figures serve to illustrate a rim projection 26 extending downwardly along the periphery of the tile 1 such that bottom portion 28 is completely surrounded by rim projection 26.

Figure 7C:
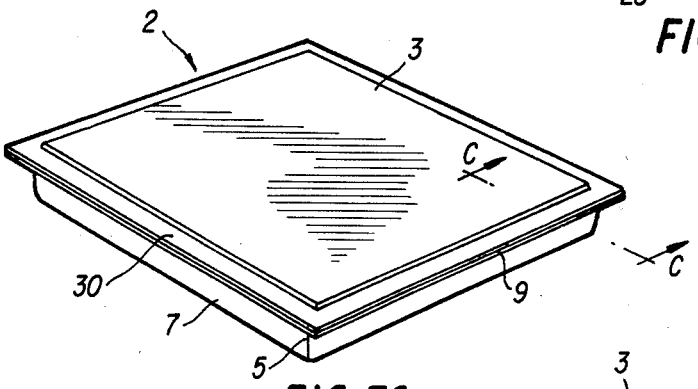
FIG. 7C is a top view of an access floor panel associated with the tile of FIG. 7A.
Figure 7D:
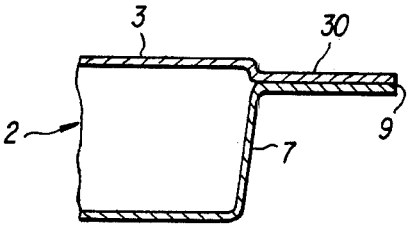
FIG. 7D is a vertical cross-sectional view on line C—C of FIG. 7C.
Figure 7E:
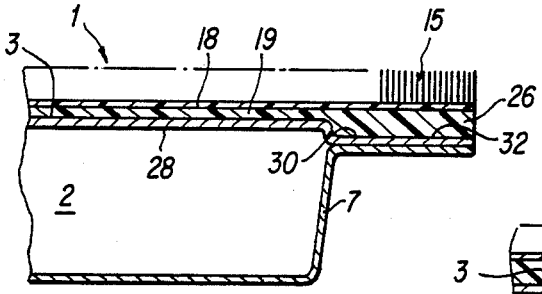
FIG. 7E is a vertical cross-sectional view showing the engagement of the elements shown in FIG. 7A and FIG. 7C.

FIG. 7C illustrates a top view of the floor panel 2 associated with the tile 1 of FIG. 7A while FIG. 7D illustrates a vertical cross-sectional view on line C—C of FIG. 7C. In these figures, reference number 30 indicates a hole or recess formed in the periphery of floor panel 2 while reference number 32 indicates an offset panel top surface. FIG. 7E sets forth a vertical cross-sectional view showing engagement of rim projection 26 with offset panel top surface 32 and which therefore serves to position, index, and maintain position modularity of the tile 1 relative to the access floor panel 2 so that again, tile 1 is removable and replaceable without the use of indexing tools or fixtures and the tile is substantially of the panel module size. Also again in this embodiment, the modularity of the panel 2 is dimensionally consistent such that the tile 1 can be relocated on any of a number of panels 2 so as to maintain a consistent modular interface.

Figure 7F:
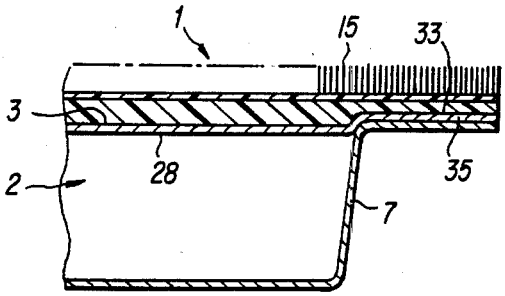
FIG. 7F shows a vertical cross-sectional view of another embodiment similar to that of FIG. 7E and showing the engagement of various elements.

FIG. 7F illustrates a vertical cross-sectional view of a variation on the embodiment of FIG. 7E wherein an offset tile lower surface 33 is used and which is cooperatively engageable with a rim projection 35 in the top surface of panel 2. The features of this embodiment are otherwise identical structurally and functionally to that of the embodiment in FIG. 7E. Therefore, in the embodiment of FIG. 7E, each of the panels 2 has at least one positioning offset 32 formed along the periphery thereof as well as rim projection 26 extending from and along the periphery of tile 1 which indexes in the positioning offset 32. In FIG. 7F, the tile 1 has a positioning offset 33 formed along the periphery thereof and the rim projection 35 extends from and along the periphery of each of the panels 2 so as to index in the positioning offset 33 formed along the periphery of the tile 1. In the embodiments shown in FIGS. 7A–7F, the above noted magnetic or pressure sensitive perimeter 8 can also be utilized if desired.

Figure 8:
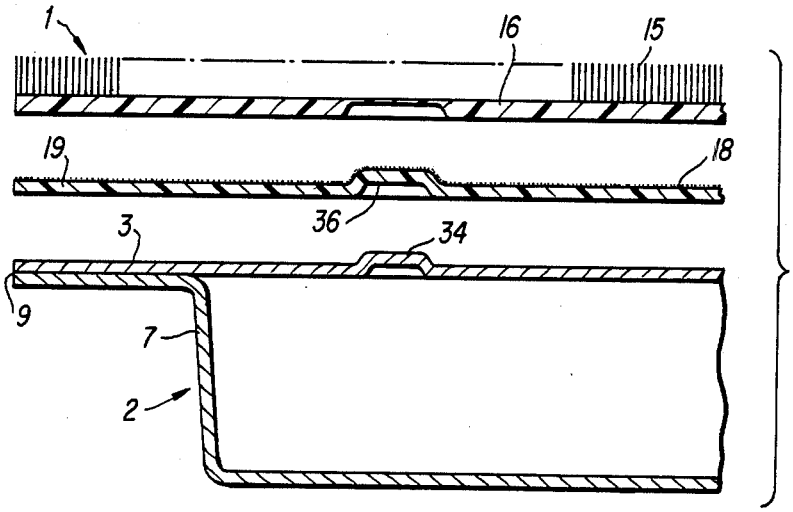
FIG. 8 is an exploded cross-sectional view similar to FIG. 4 but showing an alternative embodiment of the tile projections.

FIG. 8 illustrates an exploded cross-sectional view which is similar to that of FIG. 4 but which shows an alternative embodiment of tile projection 4. In this embodiment, a projection 34 is provided so as to extend from the top surface portion 3 of each floor panel 2 while the tile 1 has at least one positioning recess 36 formed therein such that projection 34 indexes into or with positioning hole or recess 36 formed in the tile. Otherwise, this embodiment is similar structurally and functionally to the embodiment shown in FIGS. 1–4.

Figure 9A:
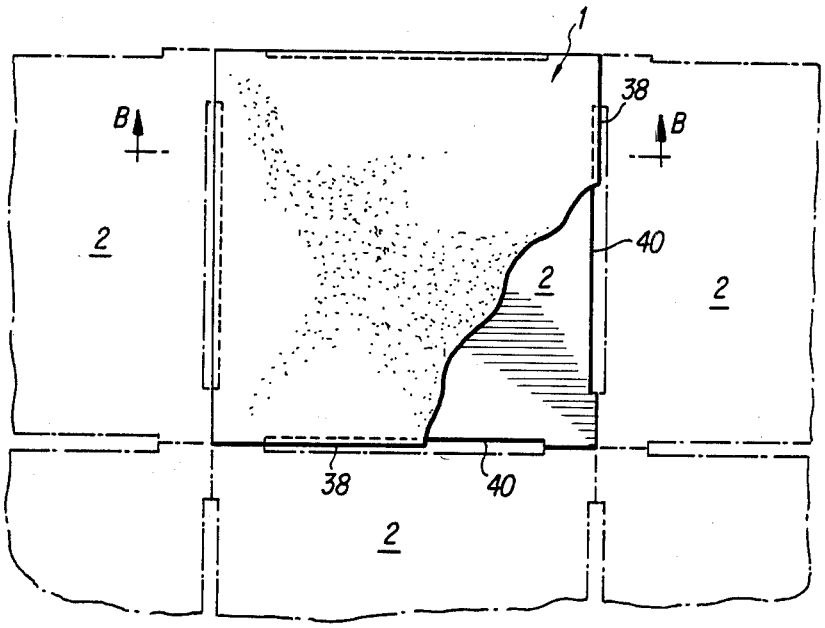
FIG. 9A is a plan view of a further embodiment with an adjacent floor panel in phantom lines.
Figure 9B:
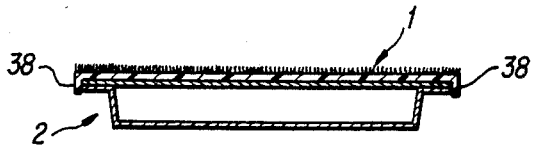
FIG. 9B is a vertical cross-sectional view on line B—B of FIG. 9A.

Lastly considering then the embodiment shown in FIGS. 9A and 9B, in this embodiment at least one peripheral recessed portion 40 is formed in each panel 2 while at least one corresponding peripheral projection 38 extends from the tile 1. Accordingly, the peripheral projection 38 is oriented so as to index in recessed portion 40 of each panel to again allow for orientation of the tile 1 to each of the panels 2 such that the tile is removable and replaceable without the use of indexing tools or fixtures and such that the tile is substantially of the panel module size. Again, the modularity of panels is dimensionally consistent such that the tile 1 can be relocated on any of the panels 2 so as to maintain a consistent modular interface. Furthermore, the use of a magnetic or pressure sensitive adhesive perimeter 8 (not shown in FIGS. 9A and 9B) can also be utilized in this embodiment.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A modular tile and access floor panel assembly, comprising:

a plurality of access floor panels of module size, each of said panels having a top surface portion, a side wall and a flange member extending from said side wall so as to directly contact said top surface portion wherein each of said panels has at least one positioning hole formed therein;

a plurality of modular tiles, each of said modular tiles lying exclusively on said top surface portion of said panels and having an outer perimeter edge portion that is equal in width and length to that of each of said panels and engageable with said outer perimeter of said top surface portion of each of said panels, respectively; and means integrally disposed on a portion of each of said tiles and within said outer perimeter portion of each of said tiles for positioning, indexing and maintaining position modularity of said tiles relative to said top surface portion of each of said panels, respectively, said means for positioning, indexing and maintaining position modularity having a configuration which orients each of said tiles to each of said panels, respectively, such that each of said tiles is removable and replacable without the use of indexing tools or fixtures and each of said tiles is substantially of said panel module size wherein said means for positioning, indexing and maintaining position modularity of said tiles further comprises at least one form projection extending from said tile which indexes in said positioning hole formed in each of said panels wherein said means for positioning, indexing and maintaining position modularity of said tiles further comprises means operatively connected with each of said tiles and engageable with each of said panels for holding a perimeter portion of each of said tiles to said perimeter portion of each of said panels, respectively, and for preventing lifting and/or curling of each of said tiles along said perimeter thereof or at a corner thereof and wherein said holding means further comprises magnetic tape.

2. An assembly according to claim 1, wherein modularity of said panels is dimensionally consistent such that each of said tiles can be relocated on any of said panels so as to maintain a consistent modular interface.

3. An assembly according to claim 1, wherein said at least one form projection further comprises a plurality of form projections in a bottom surface portion of each of said tiles which indexes into said at least one positioning hole formed in each of said panels, respectively.

4. An assembly according to claim 1, wherein the modularity of each of said panels is dimensionally consistent such that each of said tiles can be relocated on any of said panels so as to maintain a constant modular interface.

5. An assembly according to claim 1, wherein each of said panels has at least one positioning offset formed along the periphery thereof and wherein said means for positioning, indexing and maintaining position modularity further comprises a rim projection extending from and along the periphery of each of said tiles which indexes in said positioning offset formed along the periphery of each of said panels.

6. A modular tile and access floor panel assembly, comprising:

a plurality of access floor panels of module size, each of said panels having a top surface portion, a side wall and a flange member extending from said side walls so as to directly contact said top surface portion;

a plurality of modular tiles, each of said tiles having an outer perimeter portion; and means disposed on a portion of each of said tiles and within said outer perimeter portion of each of said tiles for positioning, indexing and maintaining position modularity of said tiles relative to said top surface portion of each of said panels, respectively, said means for positioning, indexing and maintaining position modularity having a configuration which orients each of said tiles to each of said panels, respectively, such that each of such tiles is removable and replaceable without the use of indexing tools or fixtures, each of said tiles is substantially of said panel module size, and each of said tiles is positionable so as to overlap at least two of said panels;

wherein said means for positioning, indexing and maintaining said position modularity of said tiles further comprises means operatively connected with each of said tiles and engageable with each of said panels for holding a perimeter portion of each of said tiles to said perimeter portion of each of said panels, respectively, for preventing lifting and/or curling of each of said tiles along said perimeter thereof or at a corner thereof; and wherein said holding means further comprises magnetic tape.

7. An assembly according to claim 6, wherein each of said panels has at least one positioning hole formed therein and wherein said means for positioning, indexing and maintaining position modularity of said tiles further comprises at least one formed projection extending from said tile which indexes in said positioning hole formed in each of said panels.

8. An assembly according to claim 6, wherein modularity of said panels is dimensionally consistent such that each of said tiles can be relocated on any of said panels so as to maintain a consistent modular interface.

9. An assembly according to claim 6, wherein each of said panels has at least one positioning hole formed therein and wherein said means for positioning, indexing and maintaining position modularity of said tiles further comprises a plurality of form projections in a bottom surface portion of each of said tiles which indexes into said at least one positioning hole formed in each of said panels, respectively.

10. An assembly according to claim 6, wherein the modularity of each of said panels is dimensionally consistent such that each of said tiles can be relocated on any of said panels so as to maintain a constant modular interface.

11. A modular tile and access floor panel assembly, comprising:

a plurality of access floor panels of module size, each of said panels having a top surface portion, a side wall and a flange member extending from said side wall so as to directly contact said top surface portion wherein each of said panels has at least one positioning hole formed therein;

a plurality of modular tiles, each of said modular tiles lying exclusively on said top surface portion of said panels and having an outer perimeter edge portion that is equal in width and length to that of each of said panels and engageable with said outer perimeter of said top surface portion of each of said panels, respectively; and means integrally disposed on a portion of each of said tiles and within said outer perimeter portion of each of said tiles for positioning, indexing and maintaining position modularity of said tiles relative to said top surface portion of each of said panels, respectively, said means for positioning, indexing and maintaining position modularity having a configuration which orients each of said tiles to each of said panels, respectively, such that each of said tiles is removable and replaceable without the use of indexing tools or fixtures and each of said tiles is substantially of said panel module size wherein said means for positioning, indexing and maintaining position modularity of said tiles further comprises at least one form projection extending from said tile which indexes in said positioning hole formed in each of said panels wherein modularity of said panels is dimensionally consistent such that each of said tiles can be relocated on any of said panels so as to maintain a consistent modular interface;

said means for positioning, indexing and maintaining position modularity of said tiles further comprises means operatively connected with each of said tiles and engageable with each of said panels for holding a perimeter portion of each of said tiles to said perimeter portion of each of said panels, respectively, and for preventing lifting and/or curling of each of said tiles along said perimeter thereof or at a corner thereof; and wherein said holding means further comprises magnetic tape.

12. A modular tile and access floor panel assembly, comprising:

a plurality of access floor panels of module size, each of said panels having a top surface portion, a side wall and a flange member extending from said side wall so as to directly contact said top surface portion wherein each of said panels has at least one positioning hole formed therein;

a plurality of modular tiles, each of said modular tiles lying exclusively on said top surface portion of said panels and having an outer perimeter edge portion that is equal in width and length to that of each of said panels and engageable with said outer perimeter of said top surface portion of each of said panels, respectively; and means integrally disposed on a portion of each of said tiles and within said outer perimeter portion of each of said tiles for positioning, indexing and maintaining position modularity of said tiles relative to said top surface portion of each of said panels, respectively, said means for positioning, indexing and maintaining position modularity having a configuration which orients each of said tiles to each of said panels, respectively, such that each of said tiles is removable and replaceable without the use of indexing tools or fixtures and each of said tiles is substantially of said panel module size wherein said means for positioning, indexing and maintaining position modularity of said tiles further comprises at least one form projection extending from said tile which indexes in said positioning hole formed in each of said panels;

said means for positioning, indexing and maintaining position modularity of said tiles further comprises means operatively connected with each of said tiles and engageable with each of said panels for holding a perimeter portion of each of said tiles to said perimeter portion of each of said panels, respectively, and for preventing lifting and/or curling of each of said tiles along said perimeter thereof or at a corner thereof; and wherein said holding means further comprises pressure sensitive tape.

13. A modular tile and access floor panel assembly, comprising:

a plurality of access floor panels of module size, each of said panels having a top surface portion, a side wall and a flange member extending from said side wall so as to directly contact said top surface portion wherein each of said panels has at least one positioning hole formed therein;

a plurality of modular tiles, each of said modular tiles lying exclusively on said top surface portion of said panels and having an outer perimeter edge portion that is equal in width and length to that of each of said panels and engageable with said outer perimeter of said top surface portion of each of said panels, respectively; and means integrally disposed on a portion of each of said tiles and within said outer perimeter portion of each of said tiles for positioning, indexing and maintaining position modularity of said tiles relative to said top surface portion of each of said panels, respectively, said means for positioning, indexing and maintaining position modularity having a configuration which orients each of said tiles to each of said panels, respectively, such that each of said tiles is removable and replaceable without the use of indexing tools or fixtures and each of said tiles is substantially of said panel module size wherein said means for positioning, indexing and maintaining position modularity of said tiles further comprises at least one form projection extending from said tile which indexes in said positioning hole formed in each of said panels; and wherein said at least one projection further comprises a projection of conductive material for providing resistance to static electricity build-up on a surface portion of said tile.

14. A modular tile and access floor panel assembly, comprising:

a plurality of access floor panels of module size, each of said panels having a top surface portion, a side wall and a flange member extending from said side walls so as to directly contact said top surface portion;

a plurality of modular tiles, each of said tiles having an outer perimeter portion; and means disposed on a portion of each of said tiles and within said outer perimeter portion of each of said tiles for positioning, indexing and maintaining position modularity of said tiles relative to said top surface portion of each of said panels, respectively, said means for positioning, indexing and maintaining position modularity having a configuration which orients each of said tiles to each of said panels, respectively, such that each of such tiles is removable and replaceable without the use of indexing tools or fixtures, each of said tiles is substantially of said panel module size, and each of said tiles is positionable so as to overlap at least two of said panels;

wherein modularity of said panels is dimensionally consistent such that each of said tiles can be relocated on any of said panels so as to maintain a consistent modular face;

said means for positioning, indexing and maintaining position modularity of said tiles further comprises means operatively connected with each of said tiles and engageable with each of said panels for holding a perimeter portion of each of said tiles to said perimeter portion of each of said panels, respectively, and for preventing lifting and/or curling of each of said tiles along said perimeter thereof or at a corner thereof; and wherein said holding means further comprises magnetic tape.

15. A modular tile and access floor panel assembly comprising:

a plurality of access floor panels of module size, each of said panels having a top surface portion, a side wall and a flange member extending from said side walls so as to directly contact said top surface portion;

a plurality of modular tiles, each of said tiles having an outer perimeter portion; and means disposed on a portion of each of said tiles and within said outer perimeter portion of each of said tiles for positioning, indexing and maintaining position modularity of said tiles relative to said top surface portion of each of said panels, respectively, said means for positioning, indexing and maintaining position modularity having a configuration which orients each of said tiles to each of said panels, respectively, such that each of such tiles is removable and replaceable without the use of indexing tools or fixtures, each of said tiles is substantially of said panel module size, and each of said tiles is positionable so as to overlap at least two of said panels;

wherein modularity of said panels is dimensionally consistent such that each of said tiles can be relocated on any of said panels so as to maintain a consistent modular face;

said means for positioning, indexing and maintaining position modularity of said tiles further comprises means operatively connected with each of said tiles and engageable with each of said panels for holding a perimeter portion of each of said tiles to said perimeter portion of each of said panels, respectively, and for preventing lifting and/or curling of each of said tiles along said perimeter thereof or at a corner thereof; and wherein said holding means further comprises pressure sensitive tape.

16. A modular tile and access floor panel assembly comprising:

a plurality of access floor panels of module size, each of said panels having a top surface portion, a side wall and a flange member extending from said side walls so as to directly contact said top surface portion;

a plurality of modular tiles, each of said tiles having an outer perimeter portion; and means disposed on a portion of each of said tiles and within said outer perimeter portion of each of said tiles for positioning, indexing and maintaining position modularity of said tiles relative to said top surface portion of each of said panels, respectively, said means for positioning, indexing and maintaining position modularity having a configuration which orients each of said tiles to each of said panels, respectively, such that each of such tiles is removable and replaceable without the use of indexing tools or fixtures, each of said tiles is substantially of said panel module size, and each of said tiles is positionable so as to overlap at least two of said panels;

wherein modularity of said panels is dimensionally consistent such that each of said tiles can be relocated on any of said panels so as to maintain a consistent modular face;

said means for positioning, indexing and maintaining position modularity of said tiles further comprises means operatively connected with each of said tiles and engageable with each of said panels for holding a perimeter portion of each of said tiles to said perimeter portion of each of said panels, respectively, and for preventing lifting and/or curling of each of said tiles along said perimeter thereof or at a corner thereof; and wherein said means for positioning, indexing and maintaining position modularity of each of said tiles further comprises at least one form projection extending from said tile and wherein said at least one projection further comprises a projection of conductive material for providing resistance to static electricity build-up on a surface portion of said tile, said means for indexing, positioning and maintaining position modularity of each of said tiles having a configuration which orients each of said tiles to each of said panels, respectively, such that each of said tiles is removable and replaceable without the use of indexing tools or fixtures.

17. A modular tile and access floor panel assembly, comprising:

a plurality of access floor panels of module size, each of said panels having a top surface portion, a side wall and a flange member extending from said side walls so as to directly contact said top surface portion;

a plurality of modular tiles, each of said tiles having an outer perimeter portion; and means disposed on a portion of each of said tiles and within said outer perimeter portion of each of said tiles for positioning, indexing and maintaining position modularity of said tiles relative to said top surface portion of each of said panels, respectively, said means for positioning, indexing and maintaining position modularity having a configuration which orients each of said tiles to each of said panels, respectively, such that each of such tiles is removable and replaceable without the use of indexing tools or fixtures, each of said tiles is substantially of said panel module size, and each of said tiles is positionable so as to overlap at least two of said panels;

wherein said means for positioning, indexing and maintaining position modularity of said tiles further comprises means operatively connected with each of said tiles and engageable with each of said panels for holding a perimeter portion of each of said tiles to said perimeter portion of each of said panels, respectively, and for preventing lifting and/or curling of each of said tiles along said perimeter thereof or at a corner thereof; and wherein said holding means further comprises pressure sensitive tape.

18. A modular tile and access floor panel assembly, comprising:

a plurality of access floor panels of module size, each of said panels having a top surface portion, a side wall and a flange member extending from said side wall so as to directly contact said top surface portion wherein each of said panels has at least one positioning hole formed therein;

a plurality of modular tiles, each of said modular tiles lying exclusively on said top surface portion of said panels and having an outer perimeter edge portion that is equal in width and length to that of each of said panels and engageable with said outer perimeter of said top surface portion of each of said panels, respectively; and means integrally disposed on a portion of each of said tiles and within said outer perimeter portion of each of said tiles for positioning, indexing and maintaining position modularity of said tiles relative to said top surface portion of each of said panels, respectively, said means for positioning, indexing and maintaining position modularity having a configuration which orients each of said tiles to each of said panels, respectively, such that each of said tiles is removable and replaceable without the use of indexing tools or fixtures and each of said tiles is substantially of said panel module size wherein said means for positioning, indexing and maintaining position modularity of said tiles further comprises at least one form projection extending from said tile which indexes in said positioning hole formed in each of said panels;

wherein said means for positioning, indexing and maintaining position modularity of said tiles further comprises means operatively connected with each of said tiles and engageable with each of said panels for holding a perimeter portion of each of said tiles to said perimeter portion of each of said panels, respectively, and for preventing lifting and/or curling of each of said tiles along said perimeter thereof or at a corner thereof; and wherein said holding means further comprises magnetic tape.

* * * * *